US006559367B1

(12) United States Patent
Yiu

(10) Patent No.: US 6,559,367 B1
(45) Date of Patent: May 6, 2003

(54) ELECTRONIC WINDCHIME DEVICE

(75) Inventor: Wai-Wah Yiu, Hong Kong (CN)

(73) Assignee: Soft Lines, Ltd., Hong Kong (CN)

( * ) Notice: Subject to any disclaimer, the term of this patent is extended or adjusted under 35 U.S.C. 154(b) by 0 days.

(21) Appl. No.: 10/006,182

(22) Filed: Dec. 6, 2001

(51) Int. Cl.[7] ..... G10D 13/08; G10K 1/062

(52) U.S. Cl. ..... 84/405; 340/392.4; 340/392.5; 340/398.2

(58) Field of Search ..... 84/402–410; 116/141, 116/169; 340/392.1, 393.2, 401.1, 398.2, 398.3, 392.4, 392.5

(56) References Cited

U.S. PATENT DOCUMENTS 5,072,208 A * 12/1991 Christensen ..... 340/392.4
6,124,539 A * 9/2000 Barnes ..... 84/402

* cited by examiner

*Primary Examiner*—Stanley J. Witkowski
(74) *Attorney, Agent, or Firm*—Pennie & Edmonds LLP

(57) ABSTRACT

The present invention offers an adjustable, versatile windless windchime activation device, which can be modified to accept and activate many different varieties of windchime assemblies. The magnetic repulsive force between an electromagnet located within the windchime activation device and a permanent magnet positioned on a sail, which sail attaches to the sound inducing member of a windchime assembly, activates the windchimes in the absence of wind.

17 Claims, 7 Drawing Sheets

ELECTRONIC WINDCHIME DEVICE

BACKGROUND OF THE INVENTION

Devices are known in which windchimes are electromagnetically activated. As an example, U.S. Pat. No. 6,124,539 proposed a mechanism to activate windchimes using a repulsive magnetic force. However, the invention harnesses the perturbation of a sail by the wind in order to activate the windchimes, and so it is not a truly windless windchime, that is, it cannot work in a windless environment. U.S. Pat. No. 5,072,208 also uses magnetic repulsive forces to activate the windchimes, and does afford windless activation. However, it is tailored to functioning with only a given set of windchimes, and is optimized for that given set of chimes alone.

The present invention offers an adjustable, versatile windless windchime activation device, which can be modified to accept and activate many different varieties of windchime assembly.

SUMMARY OF THE INVENTION

The present invention relates to an electronic windchime device capable of supporting several different kinds of windchime assembly. The main body of the device provides a support arm with a groove that allows suspension of many different types of windchime assembly. It also includes an adjustable, extendable shaft that can be modified to different lengths, to allow optimal activation of the chimes depending on the size of the user's preferred windchime assembly. A lightweight mass (referred to herein as a sail) is attached to the sound inducing member of the windchime assembly. (The sound inducing member of the windchime assembly is referred to herein as a disc). A permanent magnet attached to this sail is lowered into position above an electromagnet located in the base of the device, for example by adjusting the extendable shaft. When a voltage is applied to the electromagnet, the repulsive force of its magnetic field propelling the permanent magnet of the sail activates the windchimes in the absence of wind.

DESCRIPTION OF PREFERRED EMBODIMENTS

Figure 1:
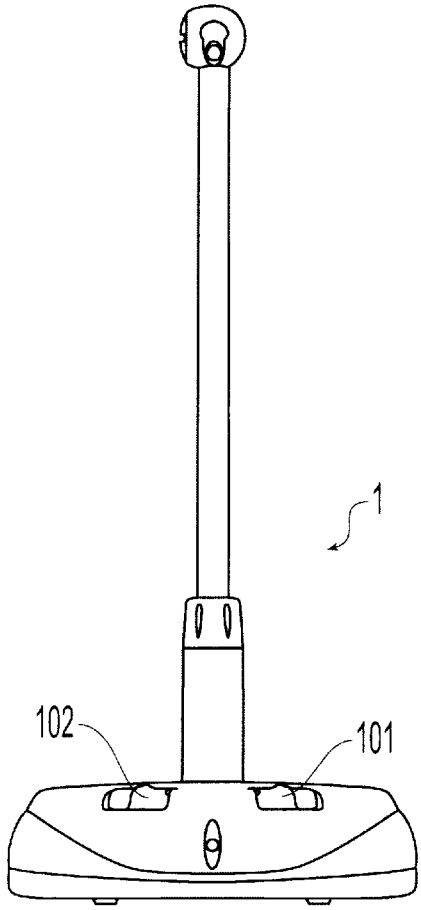
FIG. 1 is a front view of an electronic windchime device according to the present invention.

FIG. 1 is a front view of a preferred embodiment of the support device in accordance with the invention. It shows an ON/OFF/timer switch 101 located on the base of the device, which initiates operation of the device, and a switch 102 which allows the user to choose the frequency at which the users preferred windchimes assembly will be activated, as will be explained later in more detail.

Figure 2:
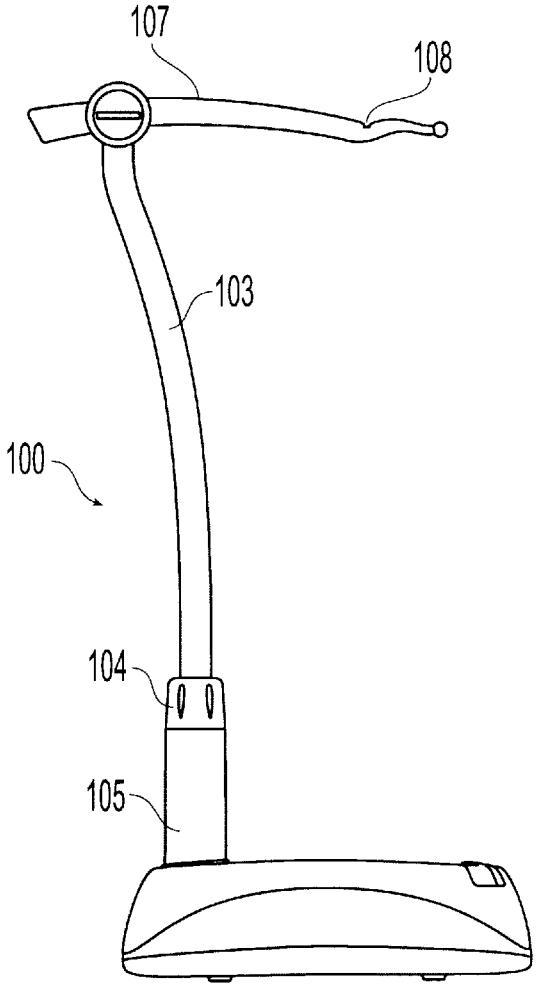
FIG. 2 is a side view of the present invention, showing the support arm for the windchime assembly and the extendable shaft.
Figure 3:
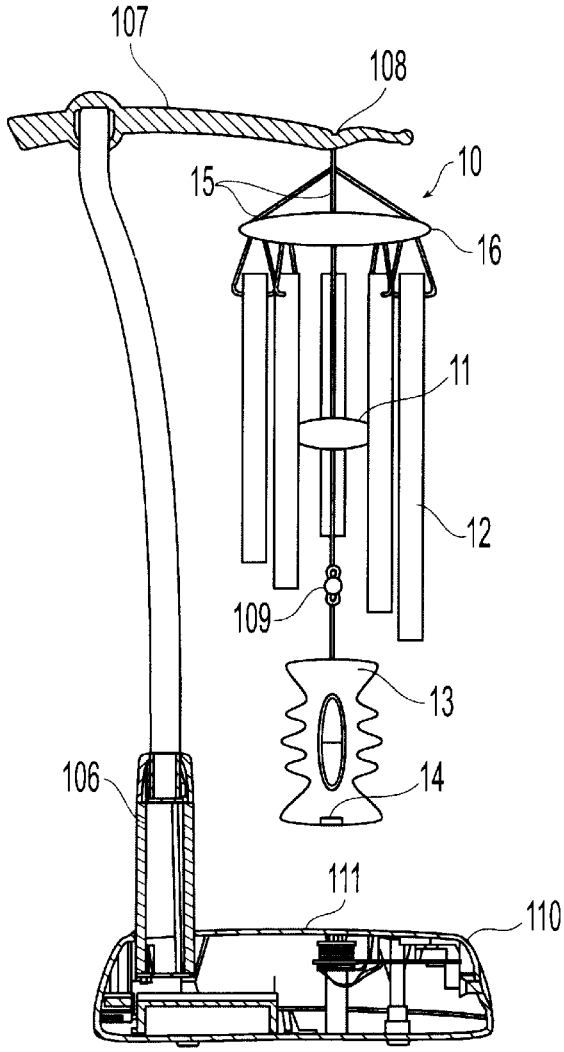
FIG. 3 is a side sectional view of the electronic windchime device with a windchime assembly in the raised position.
Figure 4A:
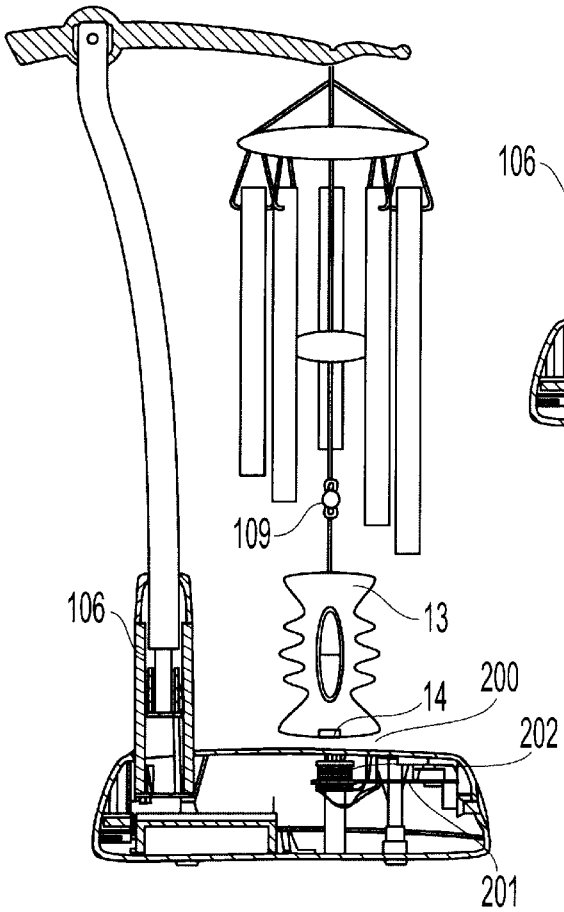
FIG. 4A is a side sectional view of the electronic windchime device with a windchime assembly in the optimal lowered position.

FIG. 2 is a side view of a preferred embodiment of the windless windchime device, showing the extendable shaft 100. The extendable shaft 100 of the windless windchime device includes a support canal 105, connected to the base of the device at one end, a clamping nut 104 located at the other end of the support canal, and the main body 103 of the extendable shaft 100. The length of the extendable shaft 100 can be modified (i.e. increased or decreased) by extending or retracting the main body 103 out of or into the support canal of the extendable shaft 100. FIGS. 3 and 4A show an exemplary guide lock 106, located inside the support canal 105, in which a portion of the main body of the extendable shaft 100 is housed when it is retracted. The clamping nut 103 is used to secure the main body of the extendable shaft 100 once the desired length is achieved. The top portion of the extendable arm is connected to a support arm 107, which possesses a groove 108 into which the desired windchime assembly is suspended, and from which the entire assembly can be detached.

Figure 4B:
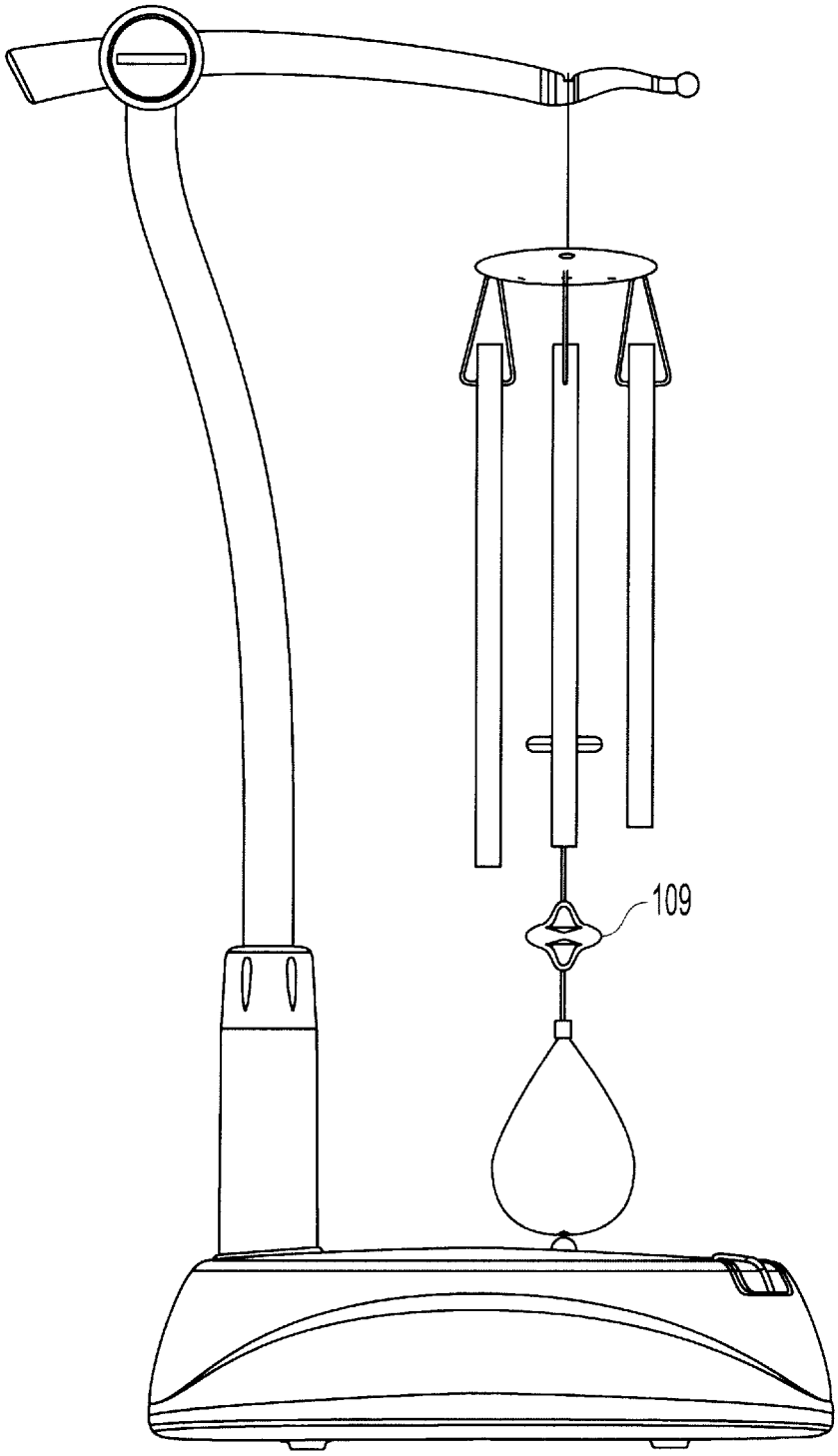
FIG. 4B shows the manipulable connector that attaches the sail to the centrally located disc.

FIGS. 3 and 4 also show a sectional side view of a preferred embodiment of the windless windchime support device (with a windchime assembly 10 suspended in the groove 108 of the support arm 107), showing the details of the base 110 of the device. FIG. 3 exemplifies the windless windchime device with the windchime assembly in a raised position, and FIG. 4A exemplifies the device with the windchime assembly lowered closer to the base. The housing 111 of the base (shown in FIG. 4A), which is preferably composed of plastic or other non-magnetic materials, encloses an electromagnet system 200, which includes an electromagnet 202, and electronic control circuitry 201 for the electromagnet. Alternatively, in another embodiment of the electronic windchime device, the magnet enclosed in the housing 111 of the base is a permanent magnet. The exemplary windchime assembly 10 includes a set of support cords 15 (consisting of one or two or more cords), one or two (or more) windchimes 12, a plate 16 (on which the windchimes are hung), and a centrally located disc 11. In other embodiments, other arrangements of windchimes to form the assembly are possible. The sail 13 attaches to the central disc of the windchime assembly by a second set of support cords 16, which lead to a connector 109. An exemplary embodiment of this connector 109 is shown in FIG. 4B. The connector 109 is manipulable such that it can be incorporated into many different kinds of windchime assemblies (as the user chooses), by linking it with the chime inducing member of the assembly. Located at the bottom of the sail is a permanent magnet 14, which is positioned directly above the solenoid coil of the electromagnet 202 of the base when the support arm 107 of the device is lowered (as exemplified in FIG. 4A). Alternatively, in another embodiment of the invention the magnet attached to the sail is an electromagnet, along with the means for applying a voltage to the electromagnet.

Figure 5:
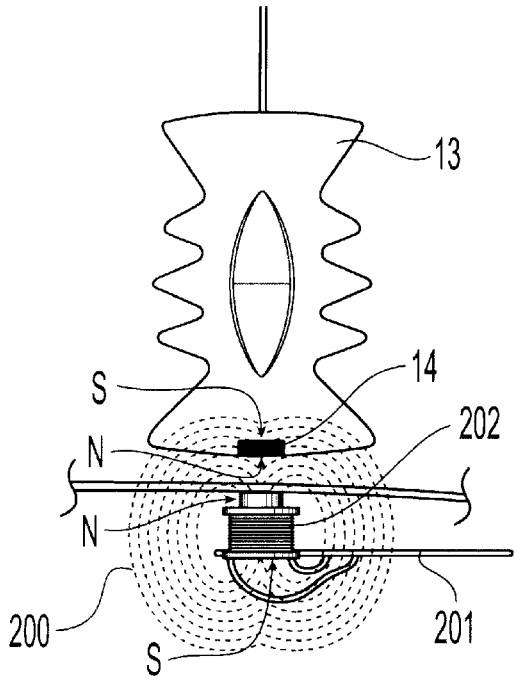
FIG. 5 is an enlarged view of the sail and electromagnet, showing the repulsive magnetic interaction.
Figure 6:
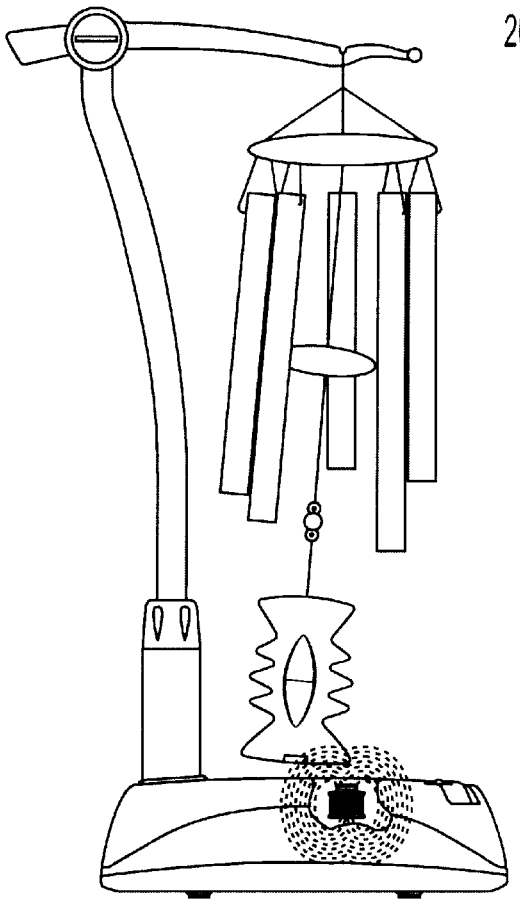
FIG. 6 is a side view of the windchime being activated by the disc of the electronic wind chime device.
Figure 7:
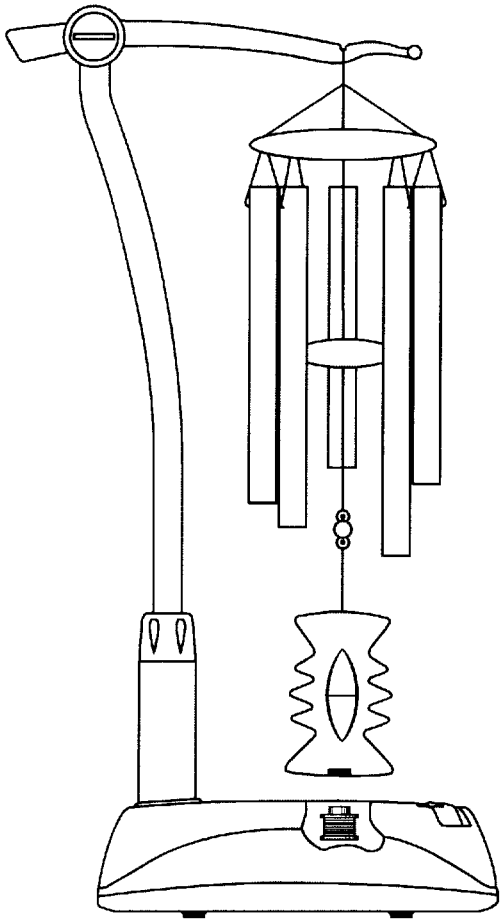
FIG. 7 is a side view of the windchime device in the central equilibrium position.
Figure 8:
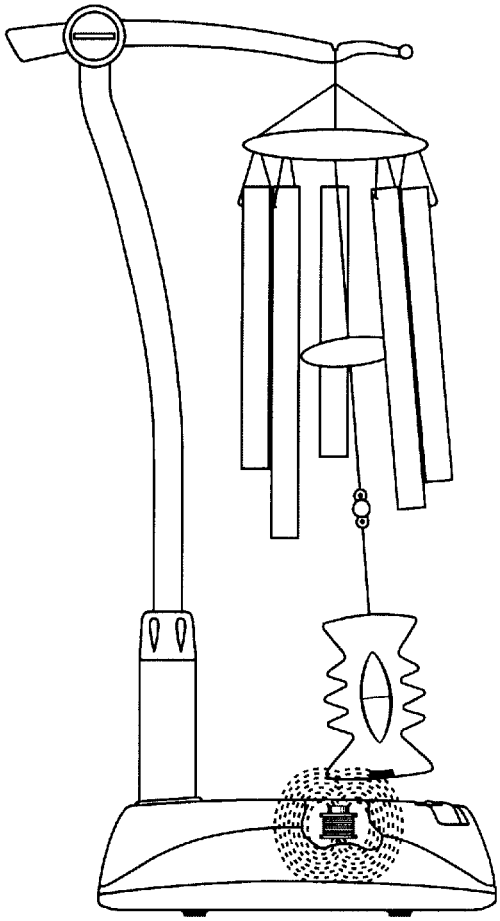
FIG. 8 is a side view of the sail of the windchime, being propelled in another direction.

FIGS. 5–8 exemplify the activation of the user desired windchime assembly while the assembly is suspended from the support arm 107 of the windless windchime device of this invention. FIG. 5 exemplifies the magnetic force operative between the permanent magnet 14 and the electromagnet 202. While current flows through the solenoid coil of the electromagnet 202, a magnetic field is present, with a given magnetic polarity. The permanent magnet 14 is oriented such that its magnetic field is directed opposite to that of the electromagnet, i.e. so that the magnetic North of the permanent magnet 14 is facing the magnetic North of the electromagnet 202. The repulsive force of the fixed electromagnet 202 acting on the permanent magnet 14 propels the sail 13 away from the equilibrium position (i.e., central position in the absence of any magnetic repulsive force) as exemplified in FIG. 6. This motion of the sail 13 to the side causes the disc 11 to come into contact with the windchimes 12 which are located near that side. The contact of the disc with the chimes 12 induces a pleasing sound from the windchimes. Subsequently, while the electromagnet 202 is not directing a repulsive magnetic force on the permanent magnet 14, the sail and disc combination will perform a pendulum motion which brings the disc repeatedly into contact with the windchimes (again inducing pleasing sounds). FIG. 7 exemplifies an instant in time (during the pendulum motion of the disc 11 and sail 13) when the sail 13 and disc 11 have both returned to the central equilibrium position. In the absence of the repulsive magnetic force, the repeated contacts of the disc with the chimes will reduce the size of the swing of the disc and sail, so that the disc will eventually no longer come into contact with the windchimes. FIG. 8 exemplifies the application of yet another electronic pulse of current to the electromagnet 202 (this time showing the sail to move in a different direction from that shown in FIG. 6, and away from center), which again propels the sail 13 and will again cause the disc 11 to come into contact with the windchimes. The extendable shaft 100 of the present invention of the windchime device is raised or lowered according to the size of the user desired windchime assembly 10 attached, so that the sail 13 is close to the base, and optimal repulsive propulsion of the sail 13 occurs, resulting in optimal activation of the given set of windchimes 12.

Figure 9:
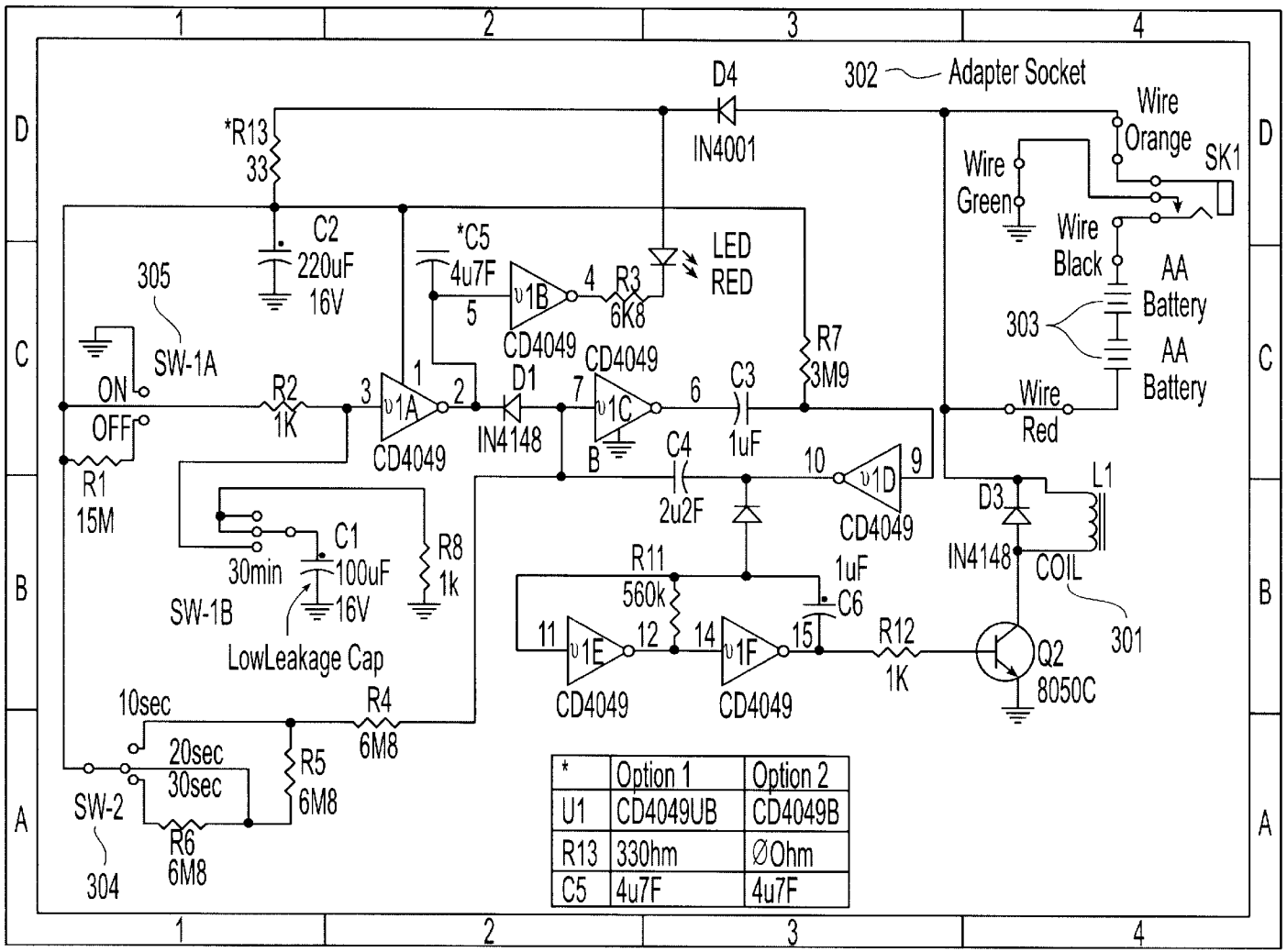
FIG. 9 exemplifies the electronic circuit that supplies the timed electronic pulses to the solenoid of the electromagnet.
Figure 10:
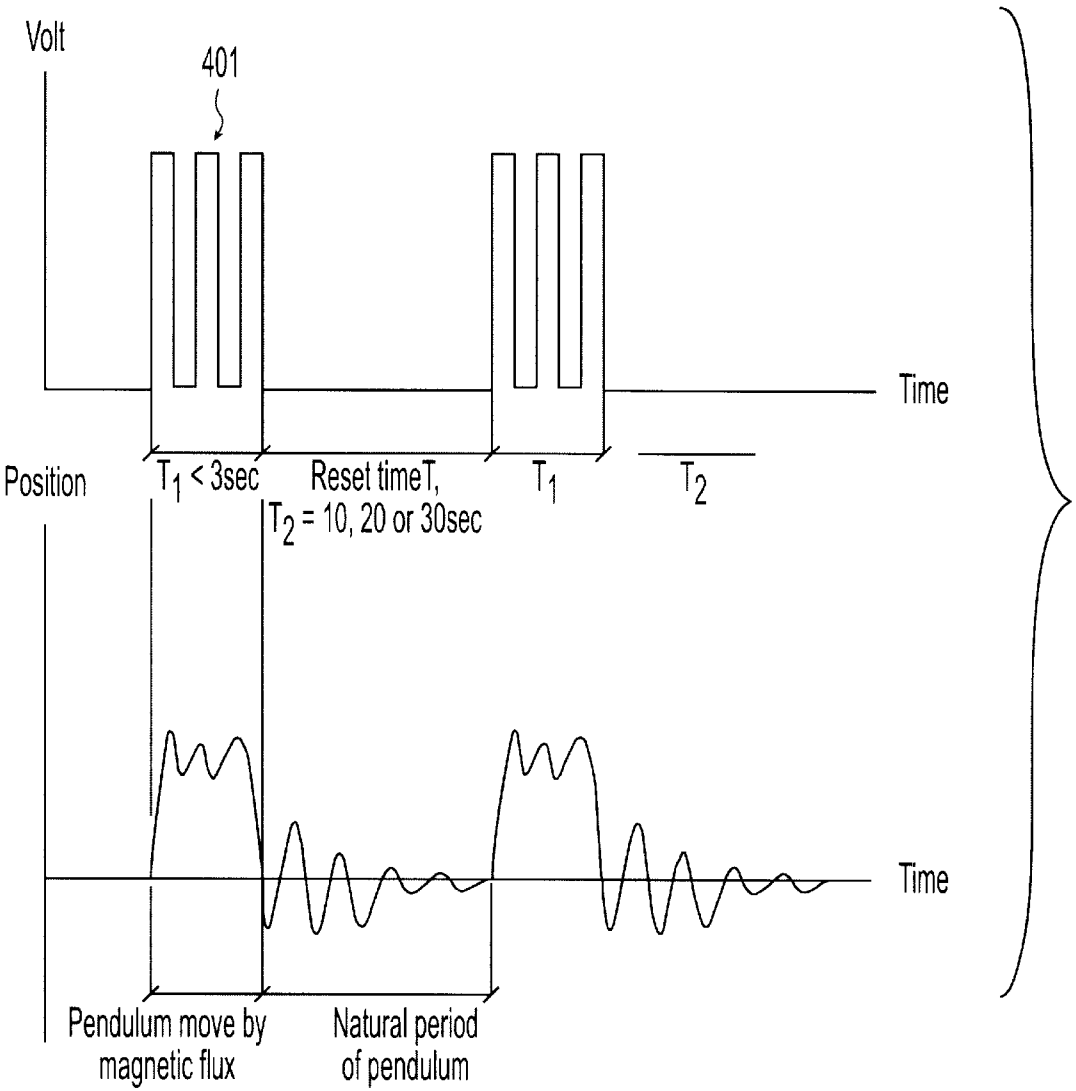
FIG. 10 is a plot showing the timing of the electronic pulses and the position of the sail away from the equilibrium position during each pulse.

FIG. 9 exemplifies the electronic circuit of the present invention, which supplies a voltage for different durations of time, and at different time intervals, to the electromagnet 202. The electromagnet 202 is illustrated in this exemplary electronic circuit by the coil 301. Energy is supplied to the circuit by a DC adaptor socket 302, or by batteries 303. However, the present invention is not limited to only these two types of power sources, or only to power sources located on the device. FIG. 10 exemplifies the time variation of the electronic pulses applied to the electromagnet, and the position of the sail away from the equilibrium center during each pulse segment.

In the embodiment illustrated, the electronic circuit provides a stream of continuous and constant essentially square pulses 401 to the solenoid 301 for a certain time T1. In the embodiment of the device exemplified in FIG. 10 there are three pulses, to closely simulate the action of the wind. However, in other embodiments there can be one, two, four or more pulses. The time T1 can vary from 1 second to 3 or more seconds. In this particular preferred embodiment of the device the time T1 is 3 seconds. During this time T1 the generated magnetic field exerts the repulsive force on the permanent magnet 14 and propels the sail away from the equilibrium position. After the three continuous pulses, there is a time delay T2 that can be selected by the switch 102 on the base of the device. In this preferred embodiment of the device T2 can be set at 10, 20 or 30 seconds by the position of the switch 304 (as shown in FIG. 9). The sound of the windchimes is more soothing for longer values of T2. The circuit repeats the activation of the windchimes with repeated over time intervals T1+T2 continuously until the device is switched off (using the ON/OFF/timer switch 101), the user can choose to control the total time of activation of the windchimes, by setting the ON/OFF/timer switch 101 to timer mode, for 30 minutes of operation, as exemplified in the electronic circuit by a switch 305 (see FIG. 9).

During the first electronic square pulse, the disc 11 contacts the windchimes because of the magnetic repulsion of the sail 13. This initiates the pendulum motion of the sail and disc. While the sail is performing this pendulum motion, the second square pulse is applied to the coil 301, which again results in the repulsion of the sail 13, and the disc contacts the windchimes again. The third square electronic results in the same sequence of actions as did the second pulse. After the third square electronic pulse is completed, the sail 13 and disc 11 continue to swing, and the disc continues making contact with the windchimes, until eventually the size of the swinging motion of the disc and sail goes to zero. The sequence of three continual pulses is chosen to stimulate the breeze, since the breeze is generally not a single occurrence, but is in fact continual pulses over a short interval of time. The three different time delay (T2) settings of the windchime support device simulate milder wind conditions to more vigorous wind conditions.

The invention described and claimed herein is not to be limited in scope by the preferred embodiments herein disclosed, since these embodiments are intended only as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A windchime device capable of operating in the absence of wind, comprising:

(a) a base comprising a magnet;

(b) an extendable shaft mounted on the base and linked to a support arm, such support arm extending outward from the shaft;

(c) a windchime assembly including one or more sound inducing members, which assembly is detachably suspendable from such support arm; and (d) a sail, which detachably attaches to the windchime assembly, such sail comprising a magnet, wherein such sail is positionable relative to the base by adjusting the extendable shaft such that magnetic interaction forces are operative between the magnets.

2. The windchime device as set forth in claim 1, wherein such base comprises an electromagnet.

3. The windchime device as set forth in claim 1, wherein such base comprises a permanent magnet.

4. The windchime device as set forth in claim 1, wherein such sail comprises an electromagnet.

5. The windchime device as set forth in claim 1, wherein such sail comprises a permanent magnet.

6. The apparatus as set forth in claim 1, wherein the extendable shaft has a length adjusting mechanism.

7. An apparatus for activating a detachable windchime assembly, comprising:

(a) a base comprising:
(i) a housing;
(ii) an electromagnet mounted within such housing; and
(iii) electronic circuitry providing current to the electromagnet;

(b) an extendable shaft mounted on the base and linked to a support arm, such support arm extending outward from the shaft; and (c) a windchime assembly detachably suspendable from such support arm, such windchime assembly comprising:
(i) a plurality of support cords;
(ii) a centrally located disc suspended from one or more of the support cords;
(iii) a plurality of windchimes suspended from the plurality of cords, and surrounding the centrally located disc; and
(iv) a sail suspended from, and detachably connectable to the disc, such sail comprising a permanent magnet, such magnet exhibiting magnetic polarity opposite to the magnetic field of the electromagnet, wherein the magnetic interaction forces between the permanent magnet and the electromagnet provide activation to induce sound from the windchimes in the absence of wind.

8. The apparatus as set forth in claim 7, wherein the electronic circuitry provides electronic pulses to the electromagnet for different lengths of time.

9. The apparatus as set forth in claim 7, wherein the electronic circuitry provides electronic pulses to the electromagnet multiple times.

10. The apparatus as set forth in claim 7, wherein the electronic circuitry provides electronic pulses to the electromagnet three times.

11. The apparatus as set forth in claim 7 wherein the electronic circuitry provides electronic pulses to the electromagnet with different time intervals between the pulses.

12. The apparatus as set forth in claim 7, wherein the electronic circuitry provides electronic pulses to the electromagnet such that the time interval between the pulses is 10 seconds.

13. The apparatus as set forth in claim 7, wherein the electronic circuitry provides electronic pulses to the electromagnet such that the time interval between the pulses is 20 seconds.

14. The apparatus as set forth in claim 7, wherein the electronic circuitry provides electronic pulses to the electromagnet such that the time interval between the pulses is 30 seconds.

15. The apparatus as set forth in claim 7, wherein the extendable shaft extends to the optimum length for maximum activation of the sail.

16. The apparatus as set forth in claim 7, wherein the extendable shaft has a length adjusting mechanism.

17. The apparatus as set forth in claim 7, wherein the housing is formed of non-magnetic material.

* * * * *